United States Patent [19]

Kumzi

[11] 4,226,147

[45] Oct. 7, 1980

[54] SLICE CONTROL CIRCUIT FOR A SLICING MACHINE

[75] Inventor: Theodore B. Kumzi, Oaklawn, Ill.

[73] Assignee: Chemetron Corporation, Chicago, Ill.

[21] Appl. No.: 955,669

[22] Filed: Oct. 27, 1978

[51] Int. Cl.[3] ..... B26D 5/30; B26D 3/22; B26D 1/28

[52] U.S. Cl. ..... 83/37; 83/42; 83/77; 83/76

[58] Field of Search ..... 83/13, 26, 37, 42, 77, 83/76, 88

[56] References Cited

U.S. PATENT DOCUMENTS

| | | | |
|---|---|---|---|
| 3,379,233 | 4/1968 | Kasper | 83/77 |
| 3,821,913 | 7/1974 | Bajcar et al. | 83/77 |
| 3,906,823 | 9/1975 | Spooner | 83/77 |
| 3,910,141 | 10/1975 | Divan | 83/88 |
| 4,015,494 | 4/1977 | Spooner et al. | 83/76 |
| 4,065,911 | 1/1978 | Fagan | 83/77 |

*Primary Examiner*—Donald R. Schran

*Attorney, Agent, or Firm*—Vincent G. Gioia; John K. Williamson

[57] ABSTRACT

A slice control circuit senses the angular position of a blade employed to slice products, such as bacon or cheese. The position information is utilized to correctly position the product relative to the blade to obtain uniform slices. When slicing is interrupted the product is withdrawn from the blade to prevent nonuniform slices. When slicing is resumed the circuit inserts the product into the blade path at the correct point of blade rotation to resume production of uniform slices. A voltage controlled oscillator maintains the product movement in synchronism with blade velocity.

19 Claims, 5 Drawing Figures

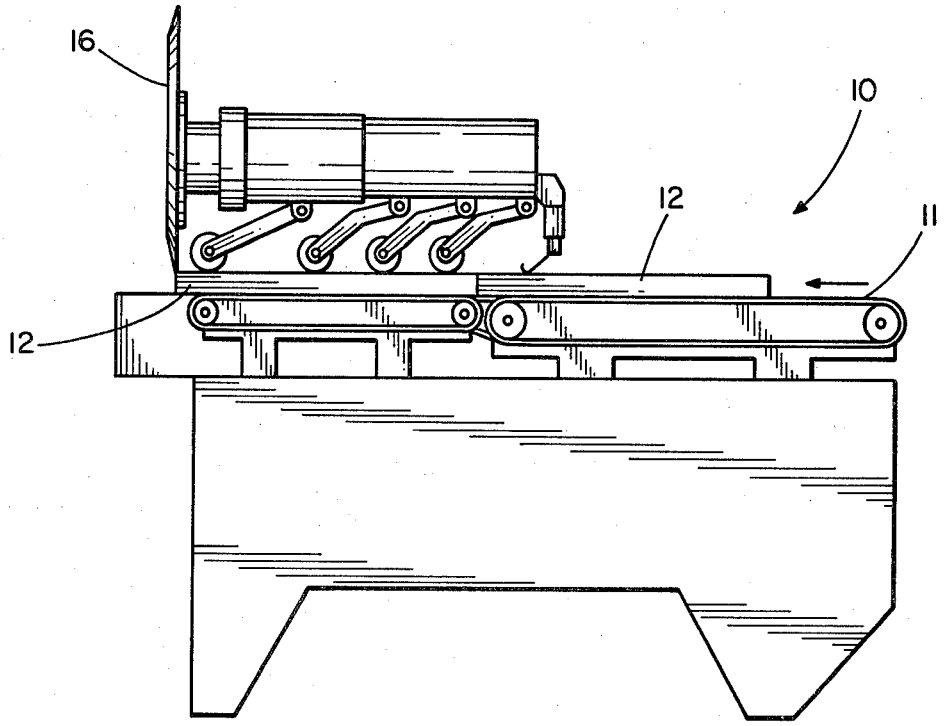
FIG.1
FIG.4
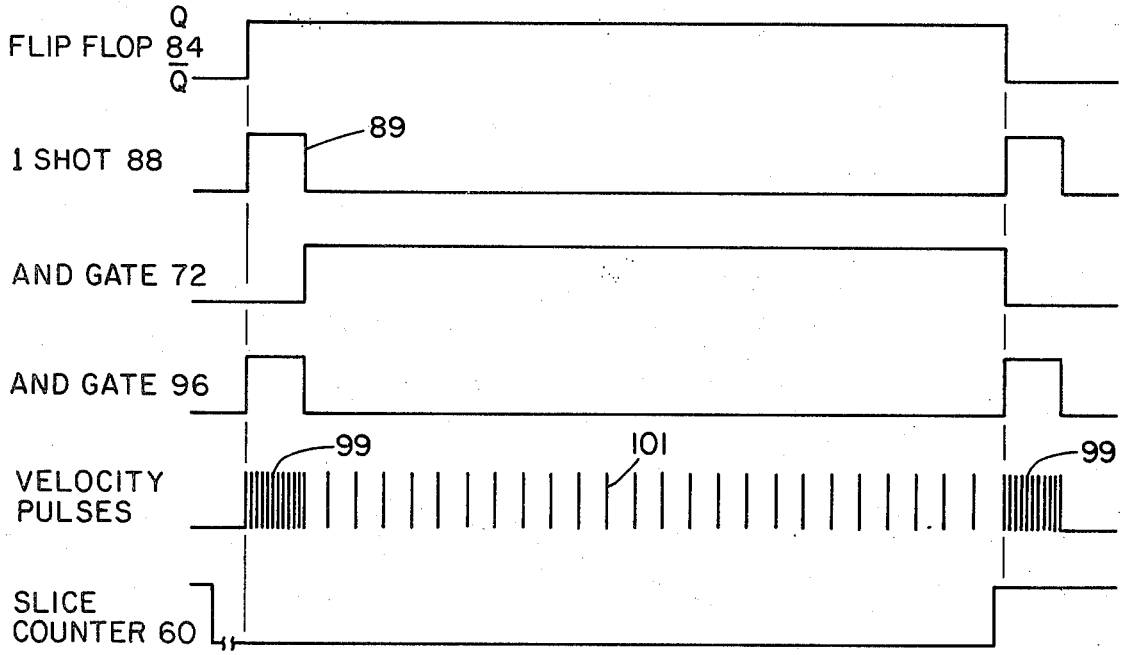
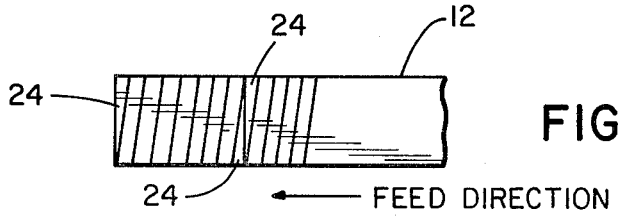
FIG.5

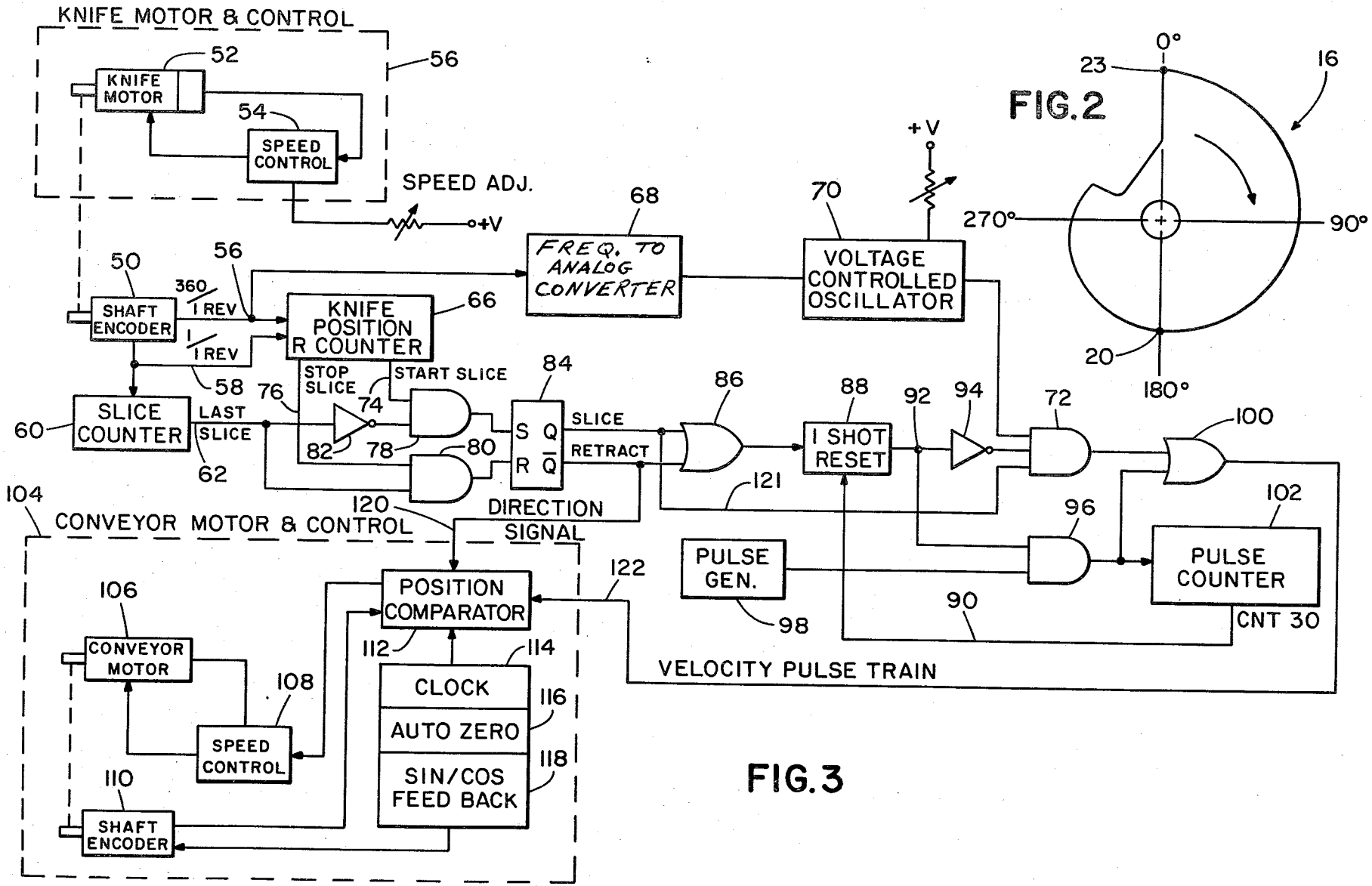
FIG. 2
FIG. 3
KNIFE MOTOR & CONTROL
KNIFE MOTOR
SPEED CONTROL
SPEED ADJ.
+V
SHAFT ENCODER
360/1 REV
1/1 REV
SLICE COUNTER
LAST SLICE
KNIFE POSITION R COUNTER
START SLICE
STOP SLICE
FREQ. TO ANALOG CONVERTER
VOLTAGE CONTROLLED OSCILLATOR
0°
90°
180°
270°
S Q
R Q
SLICE
RETRACT
1 SHOT RESET
PULSE GEN.
PULSE COUNTER
CNT 30
VELOCITY PULSE TRAIN
DIRECTION SIGNAL
POSITION COMPARATOR
CLOCK
AUTO ZERO
SIN/COS FEED BACK
CONVEYOR MOTOR & CONTROL
CONVEYOR MOTOR
SPEED CONTROL
SHAFT ENCODER

SLICE CONTROL CIRCUIT FOR A SLICING MACHINE

BACKGROUND OF THE INVENTION

This invention relates to the field of control circuits for food preparation machines. More specifically, it relates to a slice control circuit for slicing machines of the type commonly employed for producing prepackaged sliced bacon or cheese. Such machines include a conveyor system on which the product to be sliced is placed. A rotating blade is positioned transversely on the conveyor system in a manner so that the product is sliced as the conveyor moves the product towards the blade. Because the product is moving forward during the slicing there is a pronounced tendency for the slices to be offset from the vertical (FIG. 5) and this creates several problems.

In most cases it is desired that the slices be of uniform thickness and appearance. Under these circumstances waste is created in the form of nonuniform slices at the beginning and end of each slab of product. While this is normally tolerable the problem is compounded where it is necessary to frequently interrupt the slicing process as where a large slab of product is being sliced into small packages. In that case nonuniform slices, usually wedge-shaped in cross-section, are created each time the slicing is interrupted. This waste can amount to a significant loss and it is desirable to avoid such waste where possible.

In an attempt to control this waste it has been proposed to withdraw the unsliced product from the slicer blade each time it is desired to interrupt slicing and to position it, relative to the blade, in a controlled manner when it is desired to resume slicing. By a "controlled manner" it is meant that the product is reinserted into the path of the blade, at a point relative to the angular orientation of the blade, that corresponds to the position that it would have been at if the slicing had not been interrupted. If successfully accomplished, this technique can essentially eliminate waste in the form of nonuniform slices.

A hydraulic system which attempts to reduce waste is disclosed in U.S. Pat. No. 3,140,737 described more fully in the prior art statement which follows. For several reasons that device has not been commercially successful and an improved system is desirable.

It is accordingly an object of the present invention to provide a slice control circuit capable of repetitively positioning a product at a slicing point in correct relationship with a slicing blade so as to eliminate nonuniform slices.

It is a further object of the present invention to provide a conveyor positioning electronic control for a slicing machine which can determine the orientation of the slicing blade and control the conveyor responsive thereto to produce uniform slices.

Another object of the invention is to provide a slice control circuit for a slicing machine which will maintain the conveyor speed in proper relationship with blade velocity during slicing.

A further object of the invention is to provide a control circuit for a slicing machine including switchable means whereby initial positioning of the product can be accomplished at a first rate while subsequent slicing operations are accomplished at a second, slower rate.

Other objects and advantages of the invention will be apparent from the remaining portion of the specification.

PRIOR ART STATEMENT

In accordance with the provisions of 37 CFR §1.97 applicant states that the following is the closest prior art of which he is aware: U.S. Pat. No. 3,140,737 to Seiferth et al. Seiferth et al disclose a slicer control apparatus employing a hydraulically operated two way valve. The valve is controlled to position the product in the path of the slicing blade or to withdraw it for the purpose of avoiding partial cuts. A counter 60 is employed which counts the number of slices which have been cut. Upon reaching a desired number the counter causes the cylinder to withdraw the product from the slicing blade for a preset period. After the preset period the cylinder is operated to reinsert the product into the blade path. The blade rotation is tracked by means of an electric eye. Adjustments are provided to avoid nonuniform slices by varying the timing of the counter and the operation of the control valves of the cylinder.

BRIEF DESCRIPTION OF THE DRAWINGS

FIG. 1 is a simplified schematic of a slicing machine suitable for use with the present invention.

FIG. 2 is a side elevational view of the slicer blade employed in the machine of FIG. 1.

FIG. 3 is a schematic diagram of the slicer control circuit according to the present invention.

FIG. 4 is a waveform diagram useful in understanding the operation of the circuit of FIG. 3.

FIG. 5 is a schematic representation of a slab of product, such as bacon or cheese, which is to be sliced.

DETAILED DESCRIPTION

Referring to FIG. 1, a simplified view of slicing machine 10 suitable for use with the present invention is shown. The essential features of the machine are a conveyor system 11 upon which the unsliced product 12 is placed. The conveyor system is driven by a reversible motor (not shown), the speed and direction of which are controlled in a manner to be described. The conveyor system moves the meat 12 into the proximity of a rotating slicing blade 16.

A typical blade for use in a slicer of this type is illustrated in FIG. 2. Such a blade includes a spirally curved portion which slices a predetermined amount of product off of the leading end of the product as the latter travels past the blade. The slicing begins at approximately the point 20 and ends at 23 each time that the spiral portion of the blade rotates past the product. The sliced product drops onto a table or second conveyor system (not shown).

Operation of the slicing machine continues in this manner until the product has been exhausted or, as is more frequently the case, a desired amount of product has been sliced. At that point slicing is interrupted in order to permit the sliced product to be weighed and/or moved to subsequent processing stations for packaging, etc. When slicing is interrupted the conveyor 11 is desirably reversed to remove the product from the slicing blade to avoid generating partial or nonuniform slices. When it is desired to resume slicing the conveyor again moves the product towards the slicing blade.

As illustrated in FIG. 5, each time that the product 12 is repositioned in the blade path there is the possibility that partial first cuts, designated 24, will occur. Where uniformity is desired these nonuniform wedge-shaped slices must be manually removed prior to packaging and are often discarded as waste. In order to prevent nonuniform first slices when slicing is resumed it is necessary to position the product in the slicing position at the correct point relative to the blade position. If this is done slicing will resume as if it were a continuation of the previously interrupted slicing operation.

Referring to FIG. 2, it will be observed that a 360° grid has been superimposed upon the blade 16 for purposes of explaining the desired objective with respect to positioning the product adjacent the blade when slicing is to resume. The point 23 at which slicing terminates is designated as 0° while the approximate point at which slicing begins, point 20, is designated at 180°. The direction of blade rotation is as indicated by the arrow and it will be observed that due to the spiral contour of the blade there is a dwell period between each slice. That is, after point 23 passes the product no further slicing occurs until the blade rotates to again position point 20 on the product.

During continuous slicing it is during this dwell period that the product moves past the blade cutting edge by an amount corresponding to the desired thickness of the slices. To eliminate nonuniform slices when slicing is interrupted and subsequently resumed it is necessary that the slicer control circuit be able to operate the conveyor in a manner to (1) retract the product from the blade when slicing is to be interrupted to prevent the formation of nonuniform end slices, and (2) reinsert the product into the slicing position during the "dwell period" of the blade after point 23 has passed the product and before point 20 reaches the product.

Referring now to FIG. 3, a slicer control circuit capable of correctly positioning the product relative to the rotation of the blade is disclosed. This circuit is used to drive the conveyor motor control including both the speed and direction of the motor through a digital speed control system of a conventionally available type. The circuit employs a shaft encoder 50 to monitor the angular velocity of the knife motor 52. This motor is controlled by a drive amplifier 54 which is manually adjustable in a manner well known in the art. The drive motor and amplifier are contained within dashed lines 56 to indicate that they are conventional and form no part of the present invention.

Two outputs are provided from the shaft encoder 50 on lines 56 and 58, respectively. The first output is a pulse representative of each degree of rotation of the blade. Thus, 360 pulses are produced per revolution of the blade. If desired, a divider may be employed to reduce this pulse frequency if less precision is satisfactory. The second output from the encoder, on line 58, is a single pulse per blade revolution. This output is provided to a slice counter 60. Counter 60 contains the number of slices and can be set to provide an output upon reaching a preselected value corresponding to the required number of slices per package. Upon reaching the selected value an output is produced on line 62.

Alternatively, in place of counter 60 a scale or similar device measuring the weight of the sliced product can be employed to produce an output on line 62. In that case the output from the encoder on line 58 is not utilized. Regardless of the manner in which the last slice signal is produced on line 62 the remaining portion of the circuit is unchanged.

Both inputs from the shaft encoder 50 are provided to a knife position counter 66 while the output on line 56 is also provided to a frequency to analog converter 68. The converter may include a bistable multivibrator, for example, RCA part No. CD4047AE to wave shape the pulses from the encoder. The output from the multivibrator is provided to a simple RC network to produce the desired analog signal. Thus, the converter translates the pulses representing the angular velocity of the blade to an analog voltage which, in turn, is applied to a voltage controlled oscillator 70, the output of which is connected as one input to AND gate 72.

The knife position counter 66 is a digital counter of the commercially available type which should have a storage capacity at least sufficient for the number of pulses produced by the shaft encoder 50 corresponding to one revolution of the blade. In the case of the present embodiment the counter should be able to count to at least 360. The counter input on line 56 is utilized to increment the counter during blade rotation so that the angular position of the blade at any given instant can be determined by the value stored in the counter 66. At the completion of an entire revolution of the blade the output from the shaft encoder on line 58 is utilized to reset the counter to zero in preparation for the next slice.

Two outputs are obtained from the counter 66 on lines 74 and 76. The output on line 74 is the "start slice" signal and is provided as one input to AND gate 78. This signal is merely an output derived from the counter when it reaches a preselected value corresponding to the proper angular position of the blade for initiating operation of the conveyor to correctly position the product to begin or resume slicing. In theory the signal would be produced on line 74 as soon as point 23 on the blade had cleared the product slicing position initiating the blade dwell period. In practice, of course, it may be desirable to start the positioning process either earlier or later than point 23 on the blade. Regardless of what point is selected, it corresponds to a count in the position counter 66. The desired count is then provided on line 74.

In a similar fashion the appropriate point for interrupting slicing and withdrawing the product from the blade corresponds to a numerical count in counter 66 and when that count is achieved an output is provided on line 76 as one input to AND gate 80. The second input to AND gate 80 is the output on line 62 from the slice counter 60 or, alternatively, a weighing device utilized in place of counter 60. The second input to the AND gate 78 is the signal on line 62 inverted by inverter 82.

The output of AND gate 78 is provided to the set input of a flipflop 84 while the output of AND gate 80 is provided to the reset input of flipflop 84. As will be described in the "operation" portion of this specification, when flipflop 84 is set the control circuit is in a slice mode. When flipflop 84 is reset, the control circuit is in a retract or interrupt slicing mode.

Both outputs from the flipflop 84 are provided as inputs to OR gate 86 which, in turn, is connected to a one shot 88. One shot 88, when triggered by OR gate 86, generates a pulse as indicated in FIG. 4 waveform 89. The one shot can be reset prior to the completion of its present pulse by a reset line 90.

The output of the one shot is provided on line 92 as a second input to AND gate 72 via inverter 94. The one shot output is also provided as one input to an AND gate 96. The second input to gate 96 is from a pulse generator 98.

The output from AND gates 72 and 96 are provided as inputs to OR gate 100, the output from AND gate 96 also being provided to a pulse counter 102, the output of which is connected to the reset line 90 for the one shot 88.

Referring to the conveyor motor and control circuit contained within the dashed box 104, it will be observed that this subsystem includes a conveyor motor 106, a speed control 108, and a digital control system including a shaft encoder 110, position comparator 112, a system clock 114, an auto zero circuit 116 and a sine/cosine feedback circuit 118. These components are contained within the dashed box 104 to indicate that they are conventional elements commercially available and form no part of the present invention.

With specific reference to the digital control system, including components 112 to 118, the system is commercially available from sources such as Hyper-loop, Inc., of Bridgeview, Illinois. That company offers a digital control system employing velocity and position feedback to control motor speed and direction responsive to two input signals. The first input signal is a direction signal provided from the circuit according to the present invention on line 120 while the second input is a velocity pulse train provided on line 122. Based on this information, blocks 110 through 118 control the conveyor motor 106 in the desired manner. A specific device manufactured by Hyper-loop, Inc., suitable for use herein is sold under the trademark HYSTEP.

Summarizing, the digital system controls the conveyor motor 106 in response to the direction signal on line 120 and the velocity pulse train on line 122. The circuit according to the present invention generates these signals to achieve the desired objective of correctly positioning the product relative to the slicing blade to avoid nonuniform slices.

When slicing is to begin or is resumed after interruption, the velocity pulse train on line 122 is provided from the pulse generator 98 through AND gate 96 and OR gate 100. A similar statement is true when slicing is to be interrupted. The pulse generator 98 produces a high frequency pulse train to cause the conveyor to rapidly move the product toward or away from the slicing blade. In the present embodiment the pulse generator preferably has a frequency on the order of 33 K hertz. Of course, other frequencies may be suitable for different systems.

The pulse generator output is applied to the digital control system when the one shot 88 is triggered which, in turn, enables the AND gate 96. As seen in FIG. 4, the output 99 of the pulse generator is applied to the digital control system for only the period of time the one shot is enabled. This occurs each time that slicing is to be initiated or interrupted.

The pulse generator output is also applied to the counter 102 which is set to detect a selected number of pulses and to reset the one shot thereby disabling gate 96 and enabling gate 72. In this manner, after the product is correctly positioned at the slicing point or withdrawn therefrom, the high frequency pulses are no longer provided on line 122. Instead, the voltage pulses are provided by the voltage controlled oscillator 70 via AND gate 72 and OR gate 100. The pulses 101 produced by oscillator 70 are of significantly lower frequency than those produced by pulse generator 98. In fact, the output of the oscillator 70 is a function of the rotational velocity of the blade by virtue of its input being coupled to the shaft encoder 50 via the frequency to analog converter 68.

The direction signal on line 120 is connected to the Q output of the flipflop 84. The Q output of the flipflop is connected via line 121 as a third input to the AND gate 72 to insure that the voltage controlled oscillator produces the velocity pulse train only during the slicing sequence.

An important feature of the invention is the control of the conveyor speed as a function of the angular velocity of the blade. This insures that during slicing the passage of product past the blade is at a rate consistent with the blade speed to insure uniform slices of product. Thus, for example, should the knife motor 52 slow down by virtue of sample to sample variation in the product being sliced, this fact would be detected by the shaft encoder 50 and result in a lower pulse frequency from the voltage controlled oscillator 70. In turn, this would drive the conveyor at a slower rate. It should be noted, however, that the pulse generator 98 which inserts and withdraws the product is independent of knife speed to insure accurate positioning of the product.

OPERATION

From the foregoing detailed description the operation of the invention should be apparent to those skilled in the art. In order to insure completeness, however, a brief operating summary of the invention will be given. The product 12 is loaded onto the conveyor 11 and the conveyor may be manually operated to position the product into the position shown in FIG. 1. The slice counter 60 is reset, either manually or automatically, thereby generating a low signal on line 62. This is inverted by inverter 82 and provides a high signal to AND gate 78. As soon as the knife is in the correct angular position to initiate movement of the product into the blade slicing position a high signal is produced on line 74 thereby enabling gate 78 and setting flipflop 84. The start signal on line 74 is produced by the knife position counter 66 which tracks the angular velocity of the knife blade 16 by virtue of the shaft encoder 50 operatively connected to the shaft of the motor to which the knife blade is attached.

Setting flipflop 84 puts a low signal on the Q output providing a direction control signal on line 120 causing the conveyor to move the product towards the blade. At the same time the high Q output triggers the one shot 88 thereby disabling AND gate 72 and enabling AND gate 96. When gate 96 is enabled the output of the pulse generator 98 is applied to line 122 causing the digital control system to drive the conveyor rapidly forward to correctly position the product beneath the blade prior to the blade initiating a slice. Thus, when the blade finally reaches the slicing position the product will be properly located thereunder and a uniform first slice will be obtained.

The pulses from the generator 98 are counted in the pulse counter 102 and when the preselected count is reached, indicative of the point in time where it is necessary to discontinue the fast pulse train to prevent overshoot, an output is provided on line 90 which resets the one shot. When the one shot goes low inverter 94 provides a high input to gate 72. If the flipflop 84 is in the slice mode, a second high input is provided on line 121 and thus the voltage control oscillator 70 begins producing the velocity pulse train on line 122. This switching between the high frequency pulse generator 98 and the voltage controlled oscillator 70 is a significant feature of the invention. It permits synchronous operation of the blade and conveyor during slicing and a synchronous high speed insertion and withdrawal of the product when desired. Once in the slicing mode, under control of the oscillator 70, operation of the blade and conveyor continues in a synchronous manner until the slice counter 60, or the scale if that is used instead, produces a high output on line 62 indicative of the desire to interrupt the slicing process. When line 62 goes high gate 78 is disabled and one input of AND gate 80 goes high. As soon as the knife position counter 66 detects that the blade has reached the correct stopping point, an output is provided on line 76 enabling gate 80 and resetting the flipflop 84.

Resetting the flipflop reverses the polarity of the direction signal on line 120 indicating a direction away from the blade is desired. The $\overline{Q}$ output also triggers one shot 88 and, as previously described, this gates the pulse generator 98 onto line 122. The product is therefore rapidly withdrawn from the blade before a nonuniform partial slice can be cut.

After the product is withdrawn from the slicing position the one shot resets. The conveyor stops moving away from the blade since line 120, the third input to the AND gate 72, is low. The conveyor remains in this stand-by position until the slice counter 60 is reset, either manually or automatically, initiating a new slicing cycle.

During slicing, any variation in knife speed detected by the shaft encoder 50 is compensated for by reducing or increasing the output of the voltage control oscillator 70. In turn, this maintains the operation of the conveyor at the proper speed relative to the knife velocity to insure uniform slices.

While I have shown and described embodiments of this invention in some detail, it will be understood that this description and illustrations are offered merely by way of example, and that the invention is to be limited in scope only by the appended claims.

I claim:

1. A slice control circuit for a slicing machine, said machine including a motor driven reversible conveyor on which unsliced product is transported and a rotating slicing knife positioned transversely of the conveyor, said slice control circuit comprising:

(a) a pulse operated motor control for the conveyor;

(b) first means for operating said motor control to move the product toward and away from the knife at a first rate to selectively introduce the product to the knife and retract it therefrom when slicing is to begin or end, respectively;

(c) second means for operating said motor control to move the product toward the knife at a second, slower rate when slicing is to continue;

(d) means for detecting the angular orientation of said knife; and (e) means coupled with said detecting means for enabling said first means only when the knife is correctly oriented, relative to the product, to effect introduction and retraction of the product to and from the knife with the latter in a single predetermined position relative to the product.

2. The slice control circuit according to claim 1 further including means for measuring the quantity of product sliced and causing said detecting and enabling means to end slicing when a predetermined amount of product has been sliced.

3. The slice control circuit according to claim 1 wherein said first means includes:

(a) a pulse generator, (b) means for gating said pulse generator to the motor control, (c) means for terminating operation of said pulse generator and, when slicing is to continue, initiating operation of said second means.

4. The slice control circuit according to claim 3 wherein said pulse generator is a fixed frequency digital pulse generator.

5. The slice control circuit according to claim 3 wherein said terminating means includes a pulse counter receiving the output of said pulse generator and producing an output to said gating means upon the occurrence of a preselected number of pulses, said gating means changing state upon receiving said output and, when slicing is to continue, initiating operation of said second means.

6. The slice control circuit according to claim 1 wherein said second means includes:

(a) means for producing an analog voltage representative of the angular velocity of said knife, (b) an oscillator controlled by said analog voltage to produce pulses representative of said angular velocity whereby said motor control operates the conveyor synchronously with the knife to insure uniform slices while slicing continues.

7. The slice control circuit according to claim 1 wherein said means for detecting and enabling includes:

(a) an encoding means for producing pulses representative of angular rotation of the knife, (b) a position counter receiving said pulses and producing outputs representative of the occurrence of the correct knife positions to initiate and terminate slicing, respectively, to avoid partial, nonuniform slices, (c) gating means responsive to said outputs for enabling said first means and determining the direction of movement of said conveyor.

8. The slice control circuit according to claim 7 wherein said encoding means is a shaft encoder operatively connected to the shaft to which said knife is mounted for rotation.

9. The slice control circuit according to claim 2 wherein said means for detecting and enabling includes:

(a) an encoding means for producing pulses representative of angular rotation of the knife, (b) a position counter receiving said pulses and producing outputs representative of the occurrence of the correct knife positions to initiate and terminate slicing, respectively, to avoid partial, nonuniform slices.

(c) gating means responsive to said position counter outputs and to said measuring means for enabling said first means, and determining the direction of movement of said conveyor.

10. A slice control circuit for a slicing machine, said machine including a motor driven, reservsible conveyor on which unsliced product is transported, a rotating slicing knife positioned transversely of said conveyor and a pulse operated motor control for the conveyor, said slice control circuit comprising:

(a) first pulse generating means for operating said motor control when slicing is initiated or interrupted, (b) second pulse generating means producing pulses of a lower frequency than said first pulse generating means for operating said motor control during continuous slicing, (c) logic means for gating said pulse generating means to said motor control and for determining the direction of movement of said conveyor, (d) means for detecting the angular orientation of said knife relative to said conveyor and for operating the logic means responsive thereto, whereby slicing is initiated or interrupted only when the knife is correctly oriented to avoid partial, nonuniform slices.

11. The slice control circuit according to claim 10 further including means for measuring the quantity of product sliced and causing said logic means to end slicing when a predetermined amount of product has been sliced.

12. The slice control circuit according to claim 10 wherein said first pulse generating means includes:

(a) a pulse generator, (b) means for terminating operation of said pulse generator.

13. The slice control circuit according to claim 12 wherein said terminating means includes a pulse counter receiving the output of said pulse generator and producing an output to said logic means upon the occurrence of a preselected number of pulses, said logic means changing state responsive to said output and, when slicing is to continue, initiating operation of said second means.

14. The slice control circuit according to claim 10 wherein said second pulse generating means includes:

(a) means for producing an analog voltage representative of the angular velocity of said knife, (b) an oscillator controlled by said analog voltage to produce pulses representative of said angular velocity whereby said motor control operates the conveyor synchronously with the knife to insure uniform slices while slicing continues.

15. The slice control circuit according to claim 10 wherein said detecting means includes:

(a) an encoding means for producing pulses representative of angular rotation of the knife, (b) a position counter receiving said pulses and producing outputs representative of the occurrence of the correct knife positions to initiate and terminate slicing, respectively, to avoid partial, nonuniform slices, said logic means being responsive to said outputs.

16. The slice control circuit according to claim 2 or claim 11 wherein said measuring means is a slice counter.

17. The slice control circuit according to claim 2 or claim 11 wherein said measuring means is a weighing device.

18. A method of intermittently slicing a product on a slicing machine having a rotating knife to produce discrete series of slices, said method comprising the steps of:

advancing the product across the knife at a first rate until a predetermined number of whole slices has been cut to form a first said series of slices;

interrupting slicing by retracting the product from the blade at a second rate, faster than said first rate;

introducing the product to the knife by moving the product at said second rate to engage the knife with the latter in the same position relative to the product as in the start of said retracting step; and again advancing the product across the knife at said first rate whereby to form a second said series of slices, the said position of the knife at the start of said retracting step and the end of said introducing step being preselected to avoid partial, non-uniform slices at the beginning and end, respectively of said second and first series.

19. The invention of claim 18, wherein said first rate is a function of the angular velocity of said knife.

* * * * *